US011125003B2

(12) United States Patent
Partsch et al.

(10) Patent No.: US 11,125,003 B2
(45) Date of Patent: Sep. 21, 2021

(54) SYSTEM AND METHOD FOR CLOSING A DOOR OF A VEHICLE

(71) Applicant: Faraday&Future Inc., Gardena, CA (US)

(72) Inventors: Matthew Richard Partsch, San Pedro, CA (US); Padmanabhan Kumar, Fremont, CA (US); Cian John Francis Brogan, Los Angeles, CA (US); Chris McCarthy, Tracy, CA (US)

(73) Assignee: Faraday&Future Inc., Gardena, CA (US)

( * ) Notice: Subject to any disclaimer, the term of this patent is extended or adjusted under 35 U.S.C. 154(b) by 0 days.

(21) Appl. No.: 16/090,131

(22) PCT Filed: Mar. 29, 2017

(86) PCT No.: PCT/US2017/024863

§ 371 (c)(1),
(2) Date: Sep. 28, 2018

(87) PCT Pub. No.: WO2017/172999

PCT Pub. Date: Oct. 5, 2017

(65) Prior Publication Data

US 2019/0112858 A1 Apr. 18, 2019

Related U.S. Application Data

(60) Provisional application No. 62/316,506, filed on Mar. 31, 2016.

(51) Int. Cl.
*E05F 15/00* (2015.01)
*E05F 15/43* (2015.01)
(Continued)

(52) U.S. Cl.
CPC ..... *E05F 15/43* (2015.01); *E05F 5/02* (2013.01); *E05F 5/025* (2013.01); *E05F 5/027* (2013.01);
(Continued)

(58) Field of Classification Search
CPC ..... E05F 15/73; E05F 15/40; E05F 15/611; E05F 15/43; E05F 15/60; E05F 2015/432;
(Continued)

(56) References Cited

U.S. PATENT DOCUMENTS 6,445,152 B1 9/2002 Calamatas
2004/0124662 A1 7/2004 Cleland et al.
(Continued)

FOREIGN PATENT DOCUMENTS

JP 2001-132327 5/2001

OTHER PUBLICATIONS

International Search Report dated Aug. 17, 2017 for International Application No. PCT/US2017/024863.

*Primary Examiner* — Chi Q Nguyen
(74) *Attorney, Agent, or Firm* — Veros Legal Solutions, LLP

(57) ABSTRACT

A system for closing a door of a vehicle is disclosed. The system includes: at least one sensor configured to detect a velocity and a position of the door; a brake configured to decrease the velocity of the door; an actuator configured to move the door to a closed position; and a controller configured to control operation of the at least one sensor, the brake, and the actuator.

9 Claims, 6 Drawing Sheets

(51) Int. Cl.
*E05F 15/40* (2015.01)
*E05F 5/02* (2006.01)

(52) U.S. Cl.
CPC ..... *E05F 15/40* (2015.01); *E05F 2015/432* (2015.01); *E05Y 2400/32* (2013.01); *E05Y 2400/326* (2013.01); *E05Y 2400/36* (2013.01); *E05Y 2400/44* (2013.01)

(58) Field of Classification Search
CPC ..... E05F 2015/434; E05F 5/02; E05F 5/025; E05F 5/027; E05Y 2900/531; E05Y 2400/36; E05Y 2400/44; E05Y 2400/326; E05Y 2400/32
USPC ..... 49/25, 506, 26
See application file for complete search history.

(56) References Cited

U.S. PATENT DOCUMENTS

| | | | | |
|---|---|---|---|---|
| 2007/0261310 | A1 | 11/2007 | Porat et al. | |
| 2010/0228447 | A1 | 9/2010 | Serban et al. | |
| 2017/0028966 | A1* | 2/2017 | Elie | B60K 28/12 |
| 2017/0030126 | A1* | 2/2017 | Elie | B60J 5/047 |
| 2017/0030127 | A1* | 2/2017 | Elie | E05F 15/77 |
| 2017/0030137 | A1* | 2/2017 | Elie | E05F 15/77 |
| 2017/0030737 | A1* | 2/2017 | Elie | G01D 5/14 |
| 2017/0247927 | A1* | 8/2017 | Elie | E05F 15/611 |
| 2017/0247933 | A1* | 8/2017 | Elie | B60Q 9/00 |
| 2017/0251092 | A1* | 8/2017 | Elie | H04L 63/0861 |
| 2018/0371822 | A1* | 12/2018 | Rrumbullaku | E05F 15/75 |
| 2019/0071916 | A1* | 3/2019 | Dusina | E05F 13/00 |
| 2019/0301229 | A1* | 10/2019 | Kitamura | E05F 15/63 |
| 2019/0376333 | A1* | 12/2019 | Rrumbullaku | E05F 15/43 |
| 2020/0018111 | A1* | 1/2020 | Akbarian | B60R 16/03 |

* cited by examiner

500

600

SYSTEM AND METHOD FOR CLOSING A DOOR OF A VEHICLE

CROSS REFERENCE TO RELATED APPLICATIONS

The present application is a National Phase application under 35 U.S.C. § 371 of International Application No. PCT/US2017/024863, filed Mar. 29, 2017, which claims the benefit of U.S. Provisional Application No. 62/316,506, filed Mar. 31, 2016, the entirety of each of which is hereby incorporated by reference.

TECHNICAL FIELD

The present disclosure generally relates to systems and methods for closing a vehicle door, and more specifically, to systems and methods for closing a vehicle door when a user initiated closing activity is detected.

BACKGROUND

A vehicle door is usually equipped with a handle. Such a handle is often located below the outer belt line of the door and allows people to manually close the door.

Although manually closing a vehicle door may be easy to implement, there are some shortcomings. For example, an individual may unintentionally slam a door shut when the individual merely intended to use the handle to firmly close the door. Alternatively, to ensure that a door is properly closed, an individual may decide to slam the door causing high air pressure, sound, and vibration to propagate throughout the vehicle. This may cause permanent damage to the door and/or vehicle.

Powered doors, or doors that close automatically, may not require an individual to manually close a door, and instead may rely on one or more actuators.

Although automatically closing a vehicle door may be easy to implement, there are some shortcomings. For example, when an actuator closes a powered door, the door may close at an untenable and/or unsafe velocity, may shake or jitter, or may fully close without a tight seal. In particular, when a user of the vehicle slams the door, the velocity may be particularly high and does not sufficiently slow down at closing. This may cause permanent damage to the door and/or vehicle. Therefore, it may be beneficial to control operation of one or more actuators and/or other vehicle components to ensure a proper closing of a vehicle door.

SUMMARY

One aspect of the present disclosure is directed to a system for closing a door of a vehicle. The system may include at least one sensor configured to detect a velocity and a position of the door, and a brake configured to decrease the velocity of the door. An actuator may be included to move the door to a closed position, and a controller may be included to control operation of the at least one sensor, the brake, and the actuator.

One aspect of the present disclosure is directed to a method for closing a door of a vehicle. The method may include detecting, via at least one sensor, a velocity and a position of the door. The method may include moving, via an actuator, the door to a closed position, and sealing, via a cinching latch, the door at the closed position. The method may also include controlling, via a controller, operation of the at least one sensor, the brake, and the actuator.

Yet another aspect of the present disclosure is directed to a vehicle including at least one door. The vehicle may include a system for closing the door and at least one sensor configured to detect a velocity and a position of the door. The vehicle may include a brake configured to decrease the velocity of the door, an actuator configured to move the door to a closed position, and a cinching latch configured to seal the door at the closed position. The vehicle may also include a controller configured to control operation of the at least one sensor, the brake, and the actuator.

DETAILED DESCRIPTION

This disclosure is directed to a system and method for closing a vehicle door. The vehicle, on which the system and method may be implemented, may be an electric vehicle, a fuel cell vehicle, a hybrid vehicle, a conventional internal combustion engine vehicle, or combinations thereof. The vehicle may have any body style, such as a sports car, a coupe, a sedan, a pick-up truck, a station wagon, a sports utility vehicle (SUV), a minivan, or a conversion van. The vehicle may be configured to be operated by an operator, occupying the vehicle, or remotely controlled, and/or it may be autonomous.

In some embodiments, the system may be configured to close a door of the vehicle in different modes based on an operator's input. For example, the system may operate in a powered mode, in which at least a part of the closing is performed by one or more actuators controlled by a controller. The system may also include a sensor to detect a velocity and a position of the door and an object that is within a trajectory of a closing door. The system may further create a velocity profile configured to control the speed at which the door closes. The velocity profile may be used to determine an amount of current an actuator draws at a particular time during the closing of a door. It may be derived based on a current velocity and a position of the door when the door is moving from a detected open position to a closed position. In some embodiments, the system may detect that a user has initiated the door closing process, and detect a velocity and an angle of the door. A velocity profile may be determined to control the velocity of the door to automatically move the door from the detected angle to a closed position. For example, after a user pushes the door to close, the system may determine a velocity profile to slow down the door so that the velocity of the door is substantially zero at the closed position.

A velocity profile may be dynamically generated based on a variety of factors including, but not limited to: an open-door angle (e.g., a current angle of an open door before the user pushes it close), a detected peak velocity, an angle of the door at peak velocity, and/or a total time to fully close a door. A velocity profile may also include a ramp-up time and a single or multiple ramp-down times. The ramp-up time and the ramp-down times may be times during the movement of a door where the velocity of a moving door increases (e.g., when the door is pushed closed by an operator) and decreases (e.g., when the door slows down prior to closing, either on its own or as a result of a door closing control mechanism). Ramp-up times may be caused by forces applied by the user (e.g., when he slams the door), and ramp-down times may prevent a powered door from closing very quickly, potentially injuring an unsuspecting operator.

Figure 1:
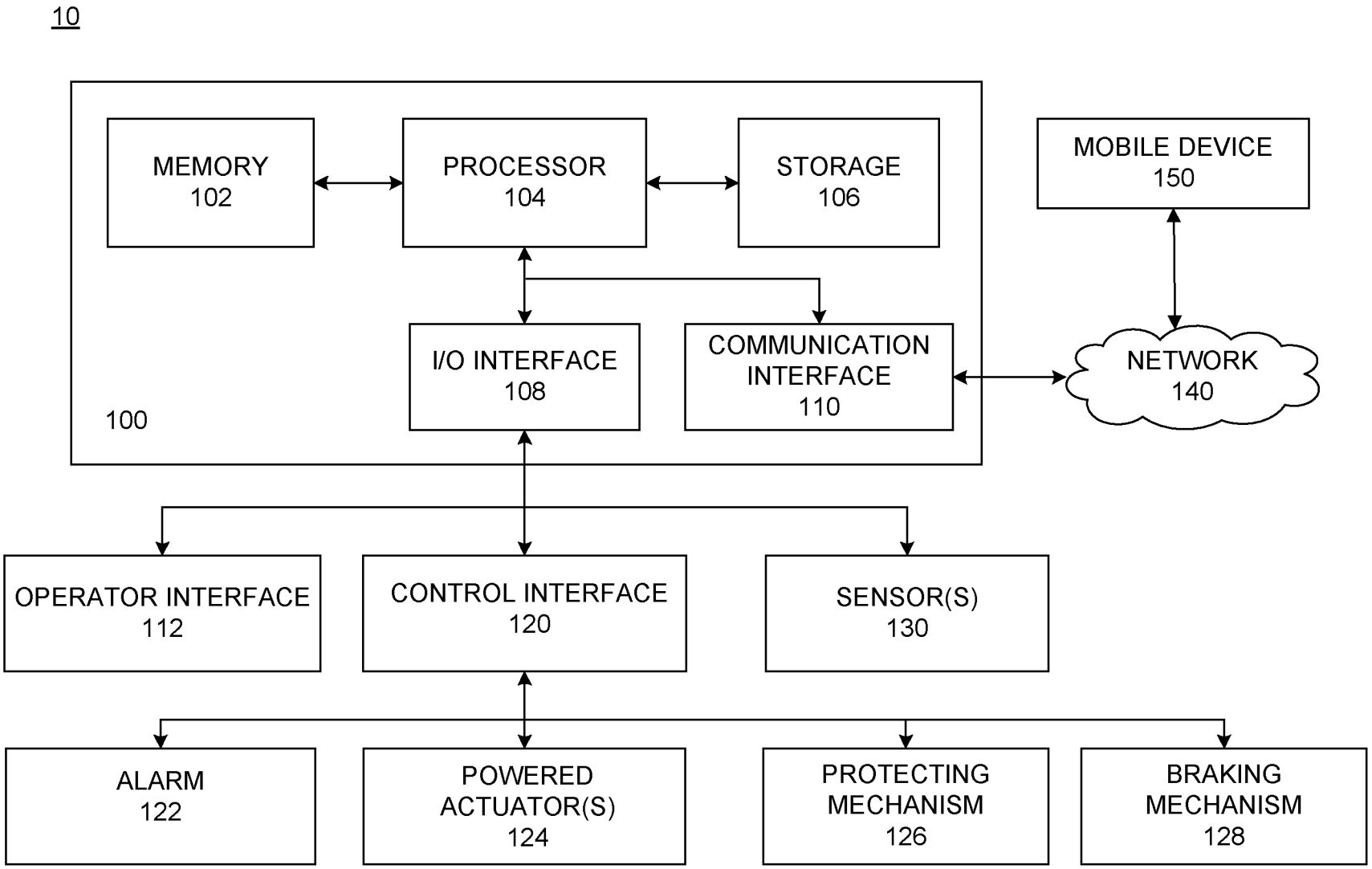
FIG. 1 is a block diagram of an exemplary system for closing a vehicle door.

FIG. 1 illustrates a block diagram of an exemplary system 10 for closing a door of a vehicle. As illustrated in FIG. 1, system 10 may include a controller 100, an operator interface 112, a control interface 120, and one or more sensors 130. System 10 may also include an alarm 122 configured to generate an audio, visual, or display alert under certain circumstances. System 10 may further include one or more actuators 124 configured to close the doors of the vehicle. In some embodiments, actuator(s) 124 may be powered. Actuators 124 may be one of a linear actuator or a motor configured to cause a door to move to a destination position determined by controller 100. For example, actuators 124 may be electrically, hydraulically, and/or pneumatically powered. Other types of actuators are contemplated. In some embodiments, system 10 may also include a protecting mechanism 126, configured to resist movement of the doors under certain circumstances, and a braking mechanism 128 configured to decrease the velocity of a closing door. Protecting mechanism 126 and braking mechanism 128 are contemplated to operate independently or co-dependently.

Controller 100 may have, among other things, a processor 104, memory 102, storage 106, an I/O interface 108, and/or a communication interface 110. At least some of these components of controller 100 may be configured to transfer data and send or receive instructions between or among each other. At least some of these components of controller 100 may be configured to generate a velocity profile for movement of the doors.

Processor 104 may be configured to receive signals from components of system 10 and process the signals to determine one or more conditions of the operations of system 10. Processor 104 may also be configured to generate and transmit a control signal in order to actuate one or more components of system 10. For example, processor 104 may determine a velocity profile, for example, by detecting a velocity and a position of the vehicle door using one or more sensors 130. Processor 104 may also generate various portions of a velocity profile that may generate the control signal. For example, processor 104 may generate portions of a velocity profile based on various inputs such as a first open-door angle, a second open-door angle, a ramp-up time percentage of total time to close a door, one or more ramp-down time percentage(s) of total time to close a door, and a total time to close a door. Using these inputs, processor 104 may be used to determine a ramp-up time, ramp-down time(s), time(s) to begin ramping down, a target time to close a door, a peak velocity and a deceleration rate. These determinations are described below in further detail (e.g., with reference to FIGS. 5 and 6).

In operation, according to some embodiments, processor 104 may execute computer instructions (program codes) stored in memory 102 and/or storage 106, and may perform exemplary functions in accordance with techniques described in this disclosure. Processor 104 may include or be part of one or more processing devices, such as, for example, a microprocessor. Processor 104 may include any type of a single or multi-core processor, a mobile device, a microcontroller, or a central processing unit.

Memory 102 and/or storage 106 may include any appropriate type of storage provided to store any type of information that processor 104 may use for operation. Memory 102 and storage 106 may be a volatile or non-volatile, magnetic, semiconductor, tape, optical, removable, non-removable, or other type of storage device or tangible (i.e., non-transitory) computer-readable medium including, but not limited to, a ROM, a flash memory, a dynamic RAM, and a static RAM. Memory 102 and/or storage 106 may also be viewed as what is more generally referred to as a "computer program product" having executable computer instructions (program codes) as described herein. Memory 102 and/or storage 106 may be configured to store one or more computer programs that may be executed by processor 104 to perform exemplary functions disclosed in this application. Memory 102 and/or storage 106 may be further configured to store data used by processor 104. For example, memory 102 and/or storage 106 may be configured to store parameters for controlling one or more actuators 124, including, for example, the distances that a door may travel during closing movement.

Memory 102 and/or storage 106 may also be configured to store the inputs used by processor 104 in determining velocity profiles as described herein. For example, memory 102 and/or storage 106 may store an open-door angle, a ramp-up percentage of total time to close a door, ramp-down percentage(s) of total time to close a door, and a total time to fully close a door. It should be appreciated that a total time to fully close a door may be the time it takes for a powered door to move from a predetermined open position to a closed position where the door is open at an open-door angle (e.g., completely open), and a target time to close a door may be the time it takes for a powered door to close from an open position where the door is at a particular angle to a closed position (e.g. as controlled by an actuator 124). Memory 102 and/or storage 106 may also store information acquired by one or more sensors 130.

I/O interface 108 may be configured to facilitate the communication between controller 100 and other components of system 10. I/O interface 108 may also receive signals from one or more sensors 130, and send the signals to processor 104 for further processing. I/O interface 108 may also receive one or more control signals from processor 104, and send the signals to control interface 120, which may be configured to control the operations of one or more sensors 130, one or more actuators 124, protecting mechanism 126, and braking mechanism 128. In some embodiments, I/O interface 108 may be configured to receive a velocity profile including a time to fully close a door, a ramp-up time, and a ramp-down time.

Communication interface 110 may be configured to transmit and receive data with, among other devices, one or more mobile devices 150 over a network 140. For example, communication interface 110 may be configured to receive from mobile device 150 a signal indicative of unlocking or locking a door after it is closed. Communication interface 110 may also transmit the signal to processor 104 for further processing.

Operator interface 112 may be configured to generate a signal for locking, unlocking, or closing the door in response to an action by an operator (e.g., a driver, a passenger, or an authorized person who can access the vehicle or close the vehicle door). Exemplary action by the operator may include a touch input, gesture input (e.g., hand waving, etc.), a key stroke, force, sound, speech, face recognition, finger print, hand print, or the like, or a combination thereof. In some embodiments, operator interface 112 may also be configured to activate or deactivate the vehicle in response to the operator's action. Operator interface 112 may also generate a signal based on the operator's action, and transmit the signal to controller 100 for further processing.

Operator interface 112 may be located on the interior side of the door and/or other component(s) inside the vehicle. Operator interface 112 may be part of or located on the exterior of the vehicle, such as, for example, an outer belt, an A-pillar, a B-pillar, a C-pillar, and/or a tailgate. Additionally or alternatively, operator interface 112 may be located on the interior side of the door and/or other component(s) inside the vehicle. For example, operator interface 112 may be part of or located on the steering wheel, the control console, and/or the interior side of the door (not shown). In some embodiments, operator interface 112 may be located on or within parts connecting the door and the locking mechanism of the vehicle. Operator interface 112 may sense a force pushing the door exerted by the operator inside or outside the vehicle, and generate a signal and/or velocity profile based on the force. For example, operator interface 112 may be a pull handle, a button, a touch pad, a key pad, an imaging sensor, a sound sensor (e.g., microphone), a force sensor, a motion sensor, or a finger/palm scanner, or the like, or a combination thereof. Operator interface 112 may be configured to receive an input from the operator. Exemplary input may include a touch input, gesture input (e.g., hand waving, etc.), a key stroke, force, sound, speech, face recognition, finger print, hand print, or the like, or a combination thereof. Operator interface 112 may also generate a signal based on the received input and transmit the signal to controller 100 for further processing.

Control interface 120 may be configured to receive a control signal from controller 100 for controlling, among other devices, sensor(s) 130, alarm 122, actuator(s) 124, protecting mechanism 126, and/or braking mechanism 128. Control interface 120 may also be configured to control sensor(s) 130, alarm 122, actuator(s) 124, protecting mechanism 126, and/or braking mechanism 128 based on the control signal.

Sensor 130 may be located on the exterior of the door or vehicle, the interior side of the door, inside the vehicle, or on the door hinge. Sensor 130 may include one or more sensors (e.g., sensors 132, 134, and/or 136 illustrated in FIG. 2) configured to determine a velocity and position of the door and/or distance between an object within a closing door trajectory. In some embodiments, sensor 130 may include an angle sensor. An angle sensor may measure the magnitude of an angle of the door relative to an orthogonally open or closed positioned. An angle sensor may be able to detect a plurality of different open-door angles. In further embodiments, sensors 130, 132, 134, and/or 136 may include a sensor configured to emit light such as visible, UV, IR, RADAR, LiDAR, and other useful frequencies for irradiating the surface of the surrounding object(s) and measuring the distance of such object(s) from the door based on the reflected light received. Sensors 130, 132, 134, and/or 136 may include an ultrasonic sensor configured to emit ultrasonic signals and detect object(s) based on the reflected ultrasonic signals. Other types of sensors for determining a velocity and position of the door and/or determining the distance between an object and a portion of the vehicle are contemplated.

Figure 2:
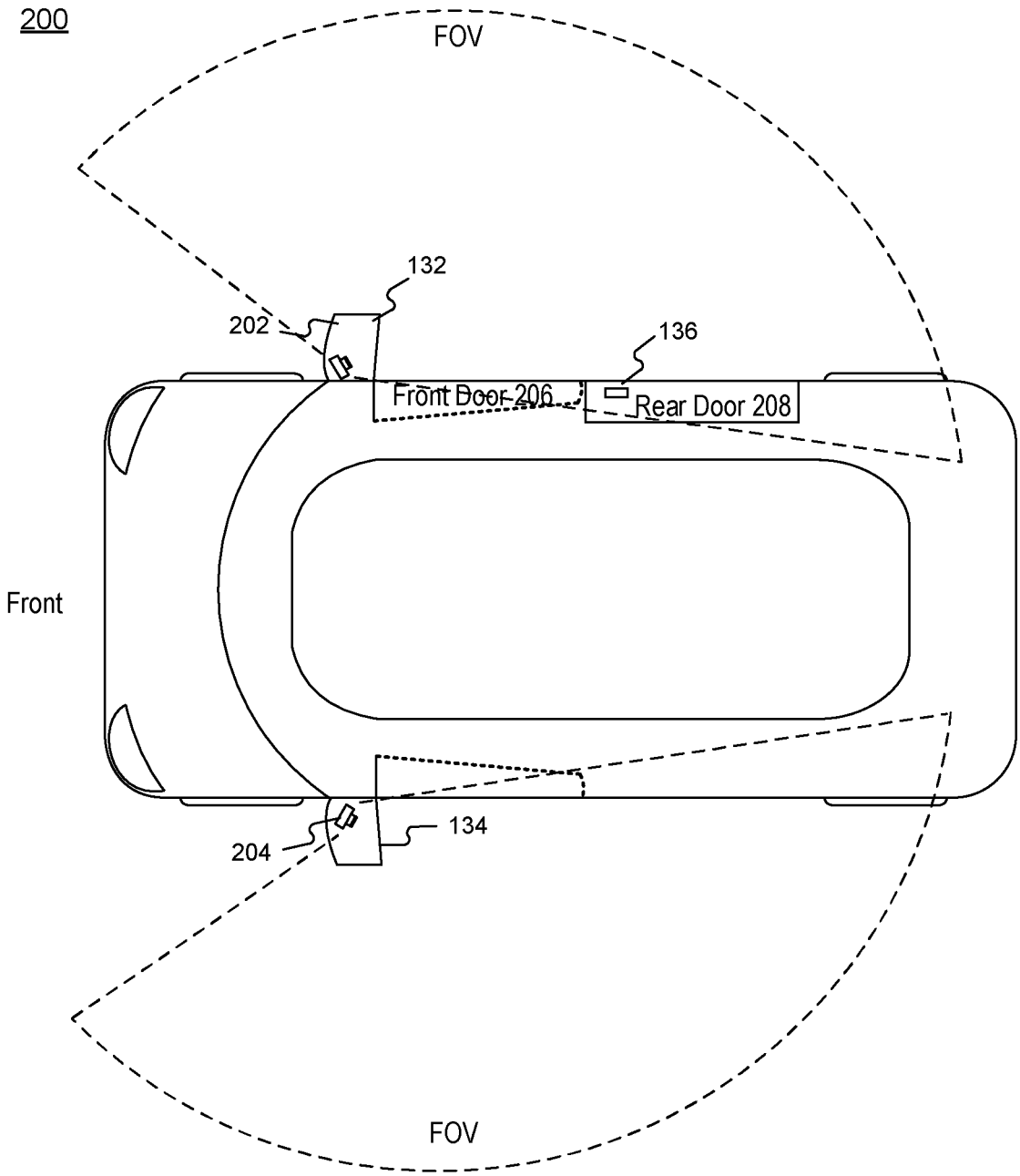
FIG. 2 is a schematic top view of an exemplary vehicle including a door configured to implement the exemplary system of FIG. 1.

FIG. 2 is a schematic top view of an exemplary vehicle 200 including a door configured to implement the exemplary system 10 of FIG. 1. As illustrated in FIG. 2, vehicle may include two side mirrors 202 and 204, on which sensors 130, 132, 134, and/or 136 may be located. Although FIG. 2 shows two sensors 132 and 134 located on the side mirrors 202 and 204, vehicle may have more sensors (including angle sensors) located on the exterior of the door or vehicle, the interior side of the door, inside the vehicle, or on the door hinge. Vehicle 200 may also include a front door 206 and a rear door 208. Additional sensor 136 may be located on rear door 208. Although FIG. 2 shows one sensor 136 located on the rear door, vehicle 200 may have more sensor(s) located on the exterior of the door or vehicle, the interior side of the door, inside the vehicle, or on the door hinge.

Figure 3:
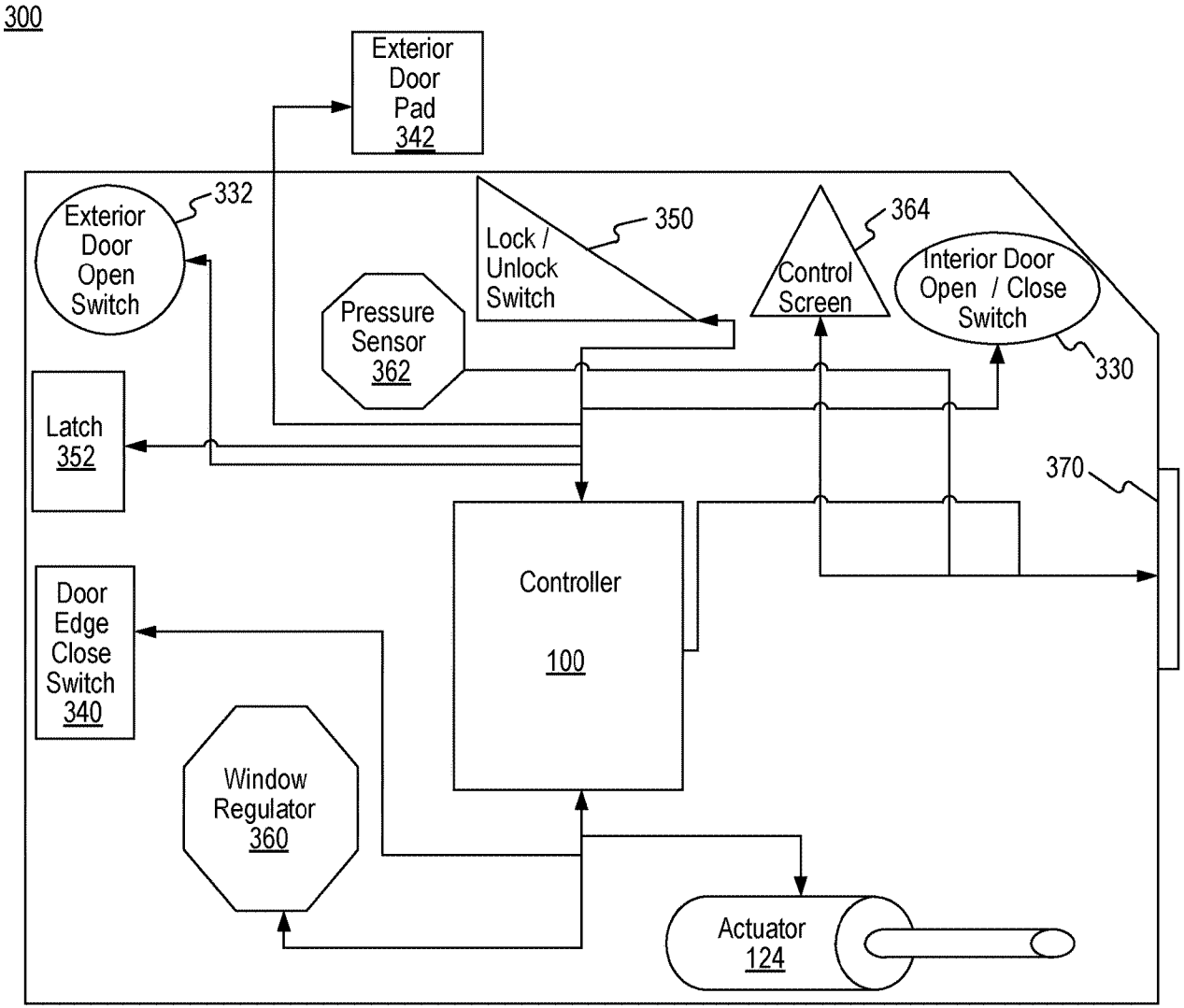
FIG. 3 is a schematic view of an exemplary vehicle door configured to implement the exemplary system of FIG. 1.

FIG. 3 is a schematic view of an exemplary vehicle door 300 configured to implement the exemplary system of FIG. 1. Vehicle door 300 may include a controller 100, an actuator 124, and various other components. For example, vehicle door 300 may also include an interior door open/close switch 330, an exterior door open switch 332, a door edge close switch 340, an exterior door pad 342, a lock/unlock switch 350, a cinching latch 352, a window regulator 360, a pressure sensor 362, a control screen 364, and/or an interface 370 that may communicatively couple components included in vehicle door 300 to the vehicle. Controller 100 may be included solely within vehicle door 300, and it may be included in one or more of vehicle door 300, and/or in a computing device included in a vehicle but not in vehicle door 300.

Figure 4:
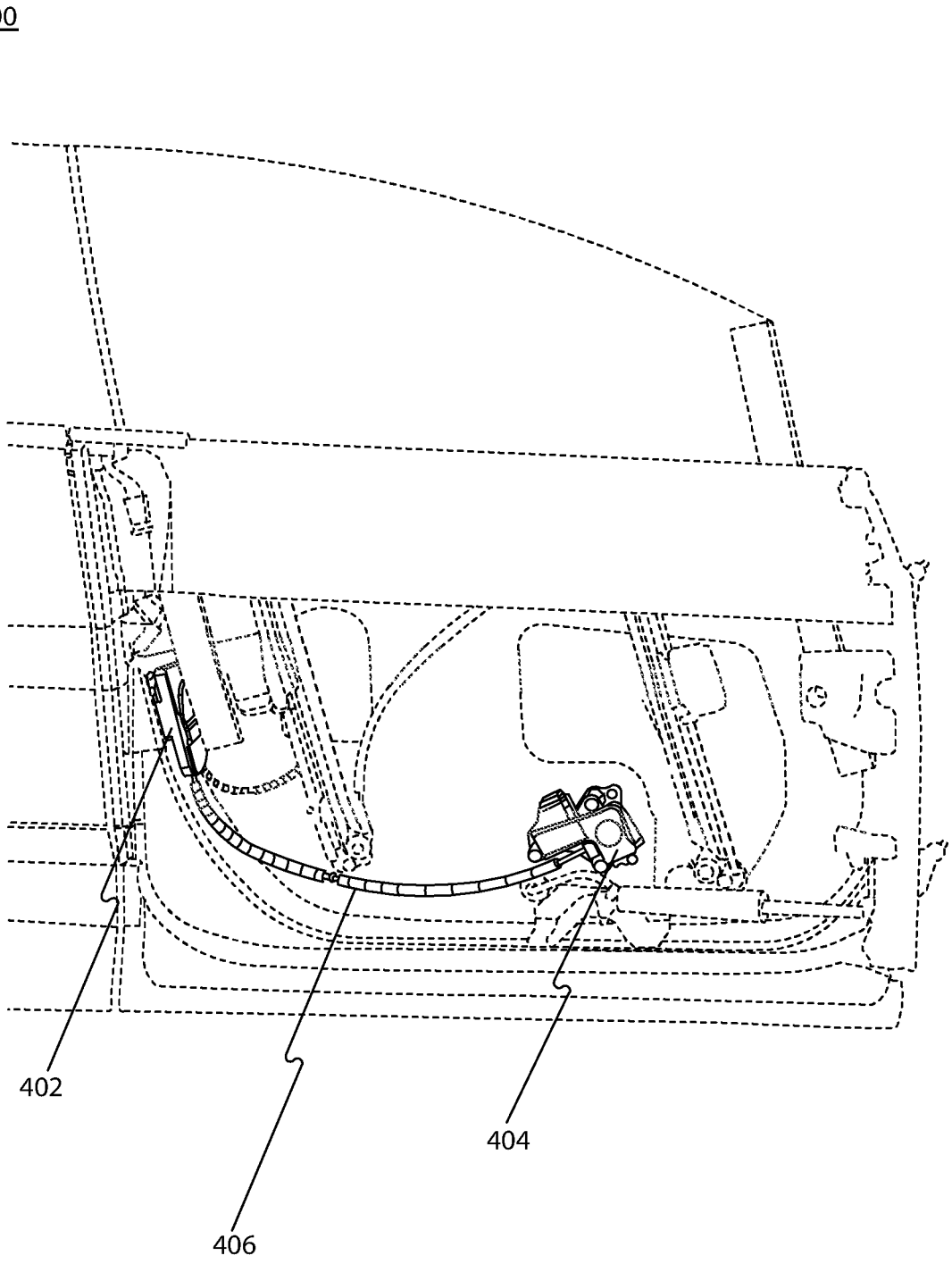
FIG. 4 is an interior view of an exemplary vehicle door configured to implement the exemplary system of FIG. 1.

FIG. 4 is an interior view of an exemplary vehicle door configured to implement the exemplary system of FIG. 1. Consistent with FIG. 3, the vehicle door 400 may include an e-release side door latch 402 including a cinching actuator 404 and a Bowden cable 406. The latch 402 may include a "claw" (not shown) that may grab onto a striker (not shown) when the door is closed in a secondary position. The cinching actuator 404 may also pull onto Bowden cable 406 causing the "claw" to rotate into a primary position. The latch 402 may include a seamless cinch configured to automatically seal a vehicle door at the closed position. The sealing of the door at the closed position is described below in further detail (e.g., with reference to FIG. 7).

Figure 5:
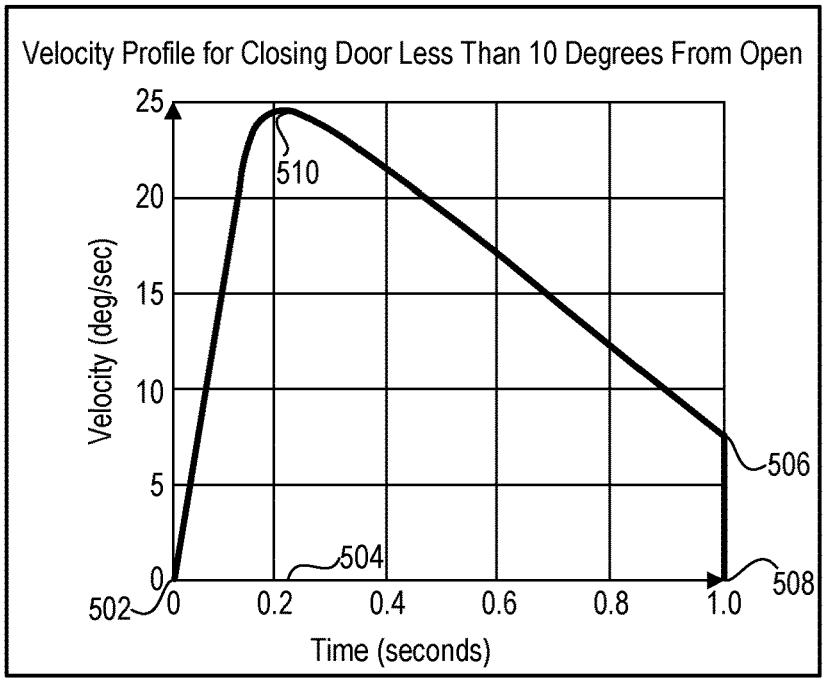
FIG. 5 illustrates an exemplary velocity profile when the door is pushed at a first open-door angle.
Figure 6:
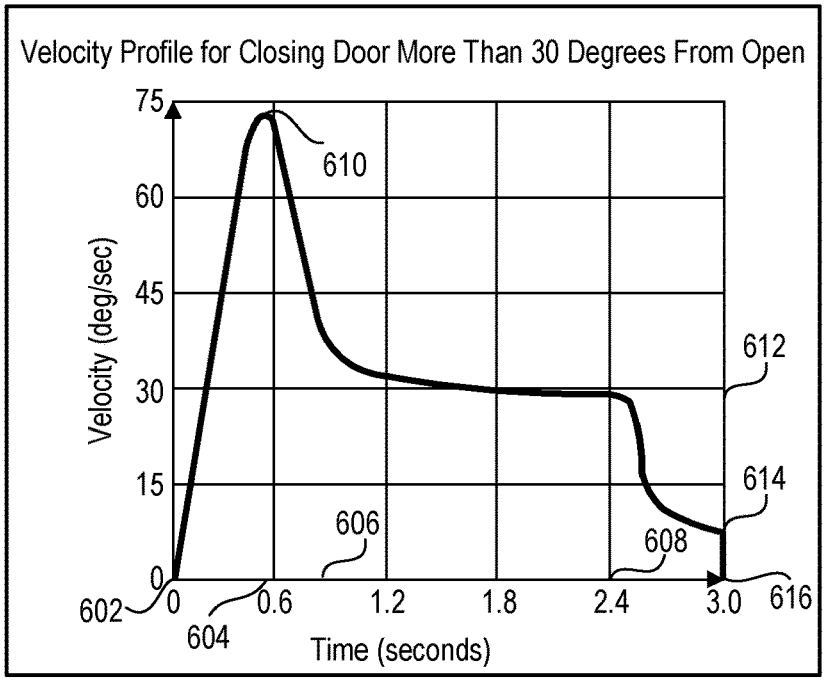
FIG. 6 illustrates an exemplary velocity profile when the door is pushed at a second open-door angle.

FIG. 5 illustrates an exemplary velocity profile 500 when the door is slammed at a first open-door angle. FIG. 6 illustrates an exemplary velocity profile 600 when the door is slammed at a second open-door angle. These velocity profiles 500 and 600 may be generated based on various attributes (e.g., parameters).

As described herein, with reference to FIG. 5, the various parameters may be stored and/or calculated to generate the exemplary velocity profile 500. In various embodiments, a ramp-up time 504, ramp-down time 506, target time to close the door 508, and peak velocity 510 may be determined based on signals detected by the sensors 130, 132, 134, and/or 136, including, e.g., a detected open-door angle, a detected peak velocity 510, and a start time 502. A first open-door angle may be about 10 degrees from a fully open position. A second open-door angle may be about 30 degrees from a fully open position. A total time to fully close the door may be the time it takes for a door to move from a start time or detected position to a closed position. A total time to fully close the door may be based on a velocity profile representative of a push force closing the door as illustrated in FIG. 5. Various and numerable open-door angles and total times to fully close the door are contemplated.

Velocity profiles 500 and 600 may be used to control the brake and/or one or more actuators to close a vehicle's door at particular speeds. A braking mechanism may be configured to decrease the velocity of a closing door. One or more actuators may draw various amounts of current in order to close a door at a specific speed. For example, rather than closing a door at a constant speed from the time a door begins closing until it stops moving, a vehicle's door may begin moving quickly based on a push or pull force, and then may decrease its velocity linearly or in in asymmetric fashion according to resistance from protecting mechanism 126 and/or braking mechanism 128. Resistance from protecting mechanism 126 and/or braking mechanism 128 may be based upon input from sensors 130 detecting a velocity and position of the door.

As illustrated in velocity profile 500, a door may begin moving at start time 502, reach peak velocity 510 at start time 502 plus ramp-up time 504. Controller 100 may compare the detected open-door angle with a predetermined angle. Various values for the predetermined angle are contemplated, including, e.g., 20 degrees. When determining that the open-door angle is less than the predetermined angle, the control may skip braking mechanism 128 all together, and the actuator may control the door closing directly. The door may begin to slow down according to velocity profile 500, until the door reaches a ramp-down time 506 where, for example, cinching actuator 404 may take over from actuator 124 to quickly finish closing and sealing a vehicle door. A total time 508 to fully close the door may include a start time 502 plus a ramp-up time 504 plus the difference between a ramp-down time 506 and ramp-up time 504. Various times for a cinching actuator 404 to take over from actuator 124 and finish closing/sealing a vehicle door are contemplated. Velocity profile 500 shows that the velocity continuously decreases from peak velocity 510. In some embodiments, the velocity may decrease substantially linearly, i.e., at a constant deceleration rate. In some other embodiments, the decrease may be design non-linear to ensure a smoother close.

As illustrated in velocity profile 600, a door may being moving at start time 602, reach peak velocity 610 at start time 602 plus ramp-up time 604, and then may slow down by braking mechanism 128 which causes the deceleration of the door during a first ramp-down time until it reaches time 606. A braking mechanism 128 is contemplated where a significant push or pull force may be exerted to close a door open at greater than the predetermined angle. Various values for the predetermined angle are contemplated. Beginning at time 606, the door may slow down on its own or hold substantially the same velocity, until it reaches another ramp-down time 608, where actuator 124 starts to take over the closing control, and further slows the door to velocity 614. In some embodiments, ramp-down time 608 may be the point the door gets to the predetermined angle, e.g., 20 degrees. Actuator 124 kicks in and moves the door from the predetermined angle to the closed position. As shown in FIG. 6, the slowdown by the actuator may be non-linear. Cinching actuator 404 may take over from actuator 124 and braking mechanism 128 at velocity 614 to slowly finish closing and sealing the vehicle door. A total time 616 to fully close the door, may include, for example a summation of the ramp-up and ramp-down times as shown in FIG. 6. Various times for a cinching actuator 404 to take over from actuator 124 and finish closing/sealing a vehicle door and/or various total times to fully close the door are contemplated.

Figure 7:
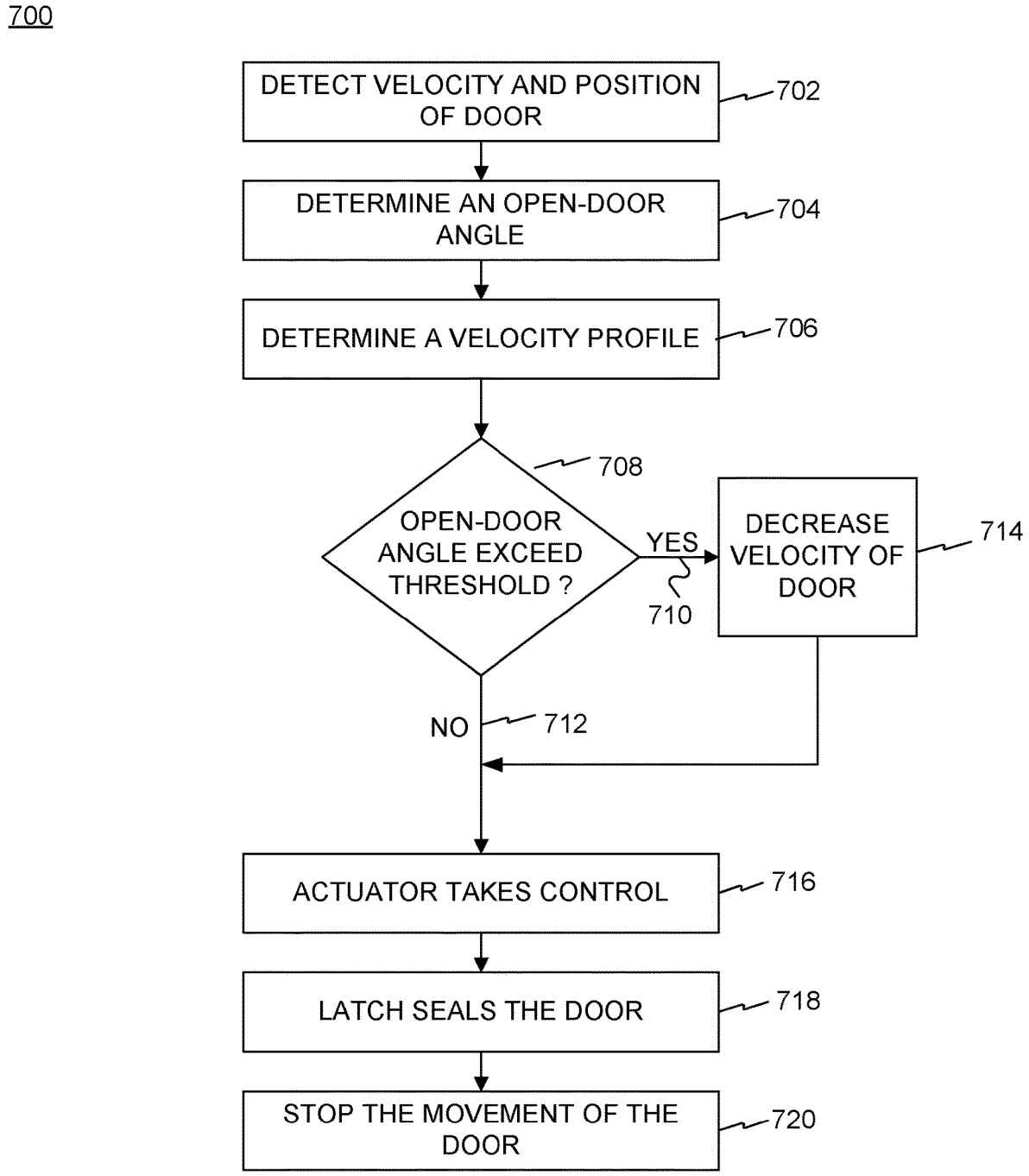
FIG. 7 is a flow chart of an exemplary process performed by the exemplary system of FIG. 1.

FIG. 7 is an exemplary flowchart of a process 700 that may be performed by the exemplary system of FIG. 1. While the exemplary method is described herein as a series of steps, it is to be understood that the order of the steps may vary in other implementations. In particular, non-dependent steps may be performed in any order, or in parallel.

At step 702, sensors 130, 132, 134, and/or 136 may detect a position (e.g. angular or locational position indicative of an open or closed front, rear, left, and/or right side door) and velocity of a door. In some embodiments, the position detection in step 702 is a door angle, sensed by one or more angle sensors. At step 704, controller 100 may determine from the detected position and velocity gleaned from sensors 130, 132, 134, and/or 136, one or more open-door angle(s) including first and second open-door angles. A first open-door angle may be less than 10 degrees from a fully open position as illustrated in FIG. 5. A second open-door may be more than 30 degrees from a fully open position as illustrated in FIG. 6.

At step 706, controller 100 may determine a velocity profile. A velocity profile may be determined based on various attributes (e.g., parameters). The various parameters may be stored and/or calculated to generate an exemplary velocity profile. In various embodiments, a ramp-up time, ramp-down time, target time to close the door, and peak velocity may be determined based on a first open-door angle, a second open-door angle, a detected peak velocity, and a start time.

At step 708, controller 100 may determine whether the door has exceeded a predetermined angle. If it is determined that the door exceeds the predetermined angle (the "YES" arrow 710 out of step 708 to step 714), the process may proceed to step 714, and a braking mechanism 128 may decrease the velocity of the door (as shown in FIG. 6) followed by step 716, where the actuator 404 may take control of the vehicular door. Optionally, between step 714 and step 716, the process may further include holding the velocity of the door substantially for at least a time period before the actuator 404 takes control in step 716. In some embodiments, sensors may continuously monitor the door-open angle, and controller 100 may determine if the door-open angle reaches a predetermined angle. Step 716 may start when the detected door-open angle reaches such a predetermined angle.

On the other hand, if this condition is not met and the door does not exceed an open-door angle threshold (the "NO" arrow 712 out of step 708 to step 716), the actuator 404 may immediately take control of the vehicular door. At step 716, the speed at which the actuator 404 closes the door at a particular point in time may be determined by the velocity profile. For example, an amount of current drawn by actuator 404 may be determined based on the velocity profile.

At step 718, cinching latch 402 and cinching actuator 404 may seal/close the door according to a first open-door angle, a second open-door angle, and/or a velocity profile. The cinching actuator 404 may pull onto Bowden cable 406 causing the "claw" to rotate, and latch 402 may include a seamless cinch configured to automatically seal a vehicle door at the closed position. At step 720, the closing movement of the door is stopped at a closed position.

While the invention has been shown and described with reference to particular embodiments thereof, it will be understood that the invention can be practiced, without modification, in other environments. The foregoing description has been presented for purposes of illustration. It is not exhaustive and is not limited to the precise forms or embodiments disclosed. Modifications and adaptations will be apparent to those skilled in the art from consideration of the specification and practice of the disclosed embodiments. Additionally, although aspects of the disclosed embodiments are described as being stored in memory, one skilled in the art will appreciate that these aspects can also be stored on other types of computer readable media, such as secondary storage devices, for example, hard disks or CD ROM, or other forms of RAM or ROM, USB media, DVD, Blu-ray, or other optical drive media.

Computer programs based on the written description and disclosed methods are within the skill of an experienced developer. Various programs or program modules can be created using any of the techniques known to one skilled in the art or can be designed in connection with existing software. For example, program sections or program modules can be designed in or by means of .Net Framework, .Net Compact Framework (and related languages, such as Visual Basic, C, etc.), Java, C++, Objective-C, HTML, HTML/AJAX combinations, XML, or HTML with included Java applets.

Moreover, while illustrative embodiments have been described herein, the scope of any and all embodiments having equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application. The examples are to be construed as non-exclusive. Furthermore, the steps of the disclosed methods may be modified in any manner, including by reordering steps and/or inserting or deleting steps. It is intended, therefore, that the specification and examples be considered as illustrative only, with a true scope and spirit being indicated by the following claims and their full scope of equivalents.

What is claimed is:

1. A method for closing a door of a vehicle, the method comprising:

detecting, via at least one sensor, a velocity and a position of the door;

moving, via an actuator, the door to a closed position;

sealing, via a cinching latch, the door at the closed position; and controlling, via a controller, operation of the at least one sensor, the brake, and the actuator.

2. The method of claim 1, wherein the detected position is an open-door angle of the door, and wherein a velocity profile is determined based on the velocity and the open-door angle.

3. The method of claim 2, further comprising determining that the open-door angle is smaller than a predetermined angle, and moving the door, via the actuator, between the open-door angle to the closed position according to the velocity profile.

4. The method of claim 2, wherein the velocity in the velocity profile continuously decreases from a peak value.

5. The method of claim 2, further comprising determining that the open-door angle is larger than a predetermined angle, and decreasing the velocity of the door, via a brake, according to the velocity profile.

6. The method of claim 5, further comprising moving the door, via the actuator, between the predetermined angle and the closed position.

7. The method of claim 5, wherein the velocity in the velocity profile remains substantially constant at least a period of time before the door reaches the closed position.

8. The method of claim 1, wherein the cinch latch includes a seamless cinch configured to automatically seal the door at the closed position.

9. The method of claim 2, further comprising an object detection sensor configured to detect an object within a projected path of the door during closing, wherein the controller is configured to determine the velocity profile such that the velocity of the door is reduced substantially to zero before the door contacts the object.

* * * * *